US010934799B2

(12) United States Patent
Maclean et al.

(10) Patent No.: US 10,934,799 B2
(45) Date of Patent: Mar. 2, 2021

(54) WELLHEAD FEED THROUGH APPARATUS FOR ELECTRICAL CABLE AND OTHER TYPES OF CONDUIT

(71) Applicant: ZiLift Holdings, Limited, Aberdeen (GB)

(72) Inventors: Iain Maclean, Aberdeen (GB); Allan Denholm, Aberdeen (GB)

(73) Assignee: ZiLift Holdings, Limited, Aberdeen (GB)

( * ) Notice: Subject to any disclaimer, the term of this patent is extended or adjusted under 35 U.S.C. 154(b) by 41 days.

(21) Appl. No.: 16/219,804

(22) Filed: Dec. 13, 2018

(65) Prior Publication Data

US 2019/0112888 A1 Apr. 18, 2019

Related U.S. Application Data

(63) Continuation of application No. PCT/GB2017/051721, filed on Jun. 13, 2017.

(60) Provisional application No. 62/349,685, filed on Jun. 14, 2016.

(51) Int. Cl.
*E21B 33/035* (2006.01)
*E21B 33/038* (2006.01)
*E21B 33/04* (2006.01)

(52) U.S. Cl.
CPC ..... *E21B 33/0385* (2013.01)

(58) Field of Classification Search
CPC ..... E21B 33/035; E21B 33/0353; E21B 33/0385; E21B 33/0407
See application file for complete search history.

(56) References Cited

U.S. PATENT DOCUMENTS 5,140,894 A 8/1992 Maxwell et al.
5,503,230 A * 4/1996 Osborne ..... E21B 33/0407 166/321
7,748,444 B2 * 7/2010 Scott ..... E21B 33/0385 166/65.1
9,470,069 B2 * 10/2016 Stubbeman ..... E21B 43/013
(Continued)

FOREIGN PATENT DOCUMENTS

CN 104716518 A 6/2015
WO 2015/173319 A1 11/2015
WO 2015173319 A1 11/2015

OTHER PUBLICATIONS

International Search Report, International Application No. PCT/GB2017/051721 dated Jul. 24, 2017.
(Continued)

*Primary Examiner* — Matthew R Buck
(74) *Attorney, Agent, or Firm* — Richard A. Fagin

(57) ABSTRACT

A wellhead valve assembly feedthrough for a cable or conduit comprises a lower connector disposed within the wellhead valve assembly and being coupled to an upper end of a cable or conduit disposed in a wellbore, and a moveable upper connector disposed above the lower connector, the upper connector extensible to connect to the lower connector and retractable to disconnect from the lower connector. The wellhead valve assembly feedthrough further includes a sealed exit arrangement having a segment of conduit or cable passing therethrough to outside the wellhead valve assembly, wherein one end of the segment of conduit of cable is connected to the upper connector.

33 Claims, 4 Drawing Sheets

(56) References Cited

U.S. PATENT DOCUMENTS

| | | | | |
|---|---|---|---|---|
| 9,702,212 | B2 * | 7/2017 | Breda | E21B 43/128 |
| 9,784,063 | B2 * | 10/2017 | June | E21B 33/035 |
| 10,337,276 | B2 * | 7/2019 | Powell | E21B 23/01 |
| 10,513,903 | B2 * | 12/2019 | Farias | E21B 33/035 |
| 2003/0056956 | A1 * | 3/2003 | Collie | E21B 33/043<br>166/336 |
| 2007/0289747 | A1 * | 12/2007 | Shaw | E21B 43/128<br>166/368 |
| 2011/0300008 | A1 * | 12/2011 | Fielder | F04D 27/00<br>417/410.3 |

OTHER PUBLICATIONS

Written Opinion of the ISA, International Application No. PCT/GB2017/051721 dated Jul. 24, 2017.
Examination Report, European Application No. 17732158.5 dated Nov. 25, 2019.
Chinese Patent Application No. 2017800368829, First Office Action, translation.

* cited by examiner

WELLHEAD FEED THROUGH APPARATUS FOR ELECTRICAL CABLE AND OTHER TYPES OF CONDUIT

CROSS REFERENCE TO RELATED APPLICATIONS

Continuation of International Application No. PCT/GB2017/051721 filed on Jun. 13, 2017. Priority is claimed from U.S. Provisional Application No. 62/349,685 filed on Jun. 14, 2016. Both the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

BACKGROUND

This disclosure relates to the field of electrical and other type of conduit (hydraulic, pneumatic etc.) passed through a wellhead or similar surface-deployed well valve system.

Many oil and gas wells (especially higher pressure wells) have a well closure valve assembly ("Christmas tree" or "Xmas tree") within a surface wellhead assembly. While Xmas trees come in many different variations and are made by several different manufacturers they are fundamentally similar in nature in containing surface valves and fittings to perform specific functions. One of the important features on a Xmas tree is a master valve to safely shut-in a well in the event of an emergency. Typically, shut-in is performed using an Emergency Shut Down (ESD) process which automatically closes the master valve using an attached actuator, such as an electric, hydraulic or pneumatically powered actuator. Therefore, it is important that a well can be safely shut in using the actuated master valve.

Modifications and changes to the Xmas tree and related fittings and flow lines are undesirable as the assembly is certified to industry and/or governmental safety standards and re-certification or acceptance of different safety systems can take excessive time and be very expensive.

In most existing applications conduit (cable, control line tubing, coil tubing, etc.) is not permanently left protruding through the Xmas tree as this would prevent the master valve from closing. Where cable passage through a Xmas tree is required such as wireline or coil tubing intervention operations, additional components (for example spool pieces) are assembled to the Xmas tree or wellhead to provide the required safety barriers.

In some applications such as cable or coil tubing deployed downhole pumps, insert gas lift, insert safety valves etc. it is required to have conduits and/or cables permanently placed inside the production tubing which need to exit through the Xmas tree. While there are some known devices which can obtain such functionality, such known solutions all have undesirable features which may make them unacceptable for safety or cost reasons.

Considerations in providing a feed through for a cable or tubing include that: (i) retaining existing Xmas tree safety functionality is desirable. In particular the master valve needs to be automatically (actuated) closed in the event of an ESD; (ii) it is undesirable to modify the Xmas tree components. An exception to the foregoing is around the "swab" valve usually at the top of the Xmas tree as this is the entry port already used for well interventions; (iii) it is undesirable to adjust flowlines attached to the wellhead because re-certification can be very expensive.

SUMMARY

An aspect of the present disclosure relates to a wellhead valve assembly feedthrough for a cable or conduit, comprising:

- a lower connector disposed within the wellhead valve assembly and being coupled to an upper end of a cable or conduit disposed in a wellbore;
- a moveable upper connector disposed above the lower connector, the upper connector extensible to connect to the lower connector and retractable to disconnect from the lower connector; and
- a sealed exit arrangement having a segment of conduit or cable passing therethrough to outside the wellhead valve assembly, wherein one end of the segment of conduit or cable is connected to the upper connector.

In some example operations, the moveable upper connector may be extended and retracted to selectively make and break a connection to accommodate required operations associated with the wellhead valve assembly and/or associated wellbore.

The wellhead valve assembly feedthrough may comprise an actuator, such as a linear actuator, coupled to the upper connector. Operation of the actuator may provide movement to the upper connector. The linear actuator may comprise at least one of an electrically, pneumatically and hydraulically operated actuator.

The lower connector may be disposed below a master valve in the wellhead assembly. The moveable upper connector may be moveable through the master valve. The moveable upper connector may be retractable to a position above the master valve. In some examples the moveable upper connector may be retractable to disconnect from the lower connector prior to operation, for example a closing operation, of the master valve.

The master valve may comprise a power operated actuator. In such an arrangement the master valve may be defined as an actuated master valve. The power operated actuator may comprise at least one of an electrical, pneumatic and hydraulic powered actuator.

In some examples the master valve may comprise a manually operated valve.

The lower connector may be disposed below an upper master valve in the wellhead valve assembly. The moveable upper connector may be moveable through the upper master valve. In some examples the moveable upper connector may be retractable to disconnect from the lower connector prior to operation, for example a closing operation, of the upper master valve. The upper connector may be retractable to above the upper master valve.

The upper master valve may comprise a power operated actuator. In such an arrangement the upper master valve may be defined as an actuated master valve. The power operated actuator may comprise at least one of an electrical, pneumatic and hydraulic powered actuator.

The lower connector may be disposed below a lower master valve in the wellhead valve assembly. The moveable upper connector may be moveable through the lower master valve. In some examples the moveable upper connector may be retractable to disconnect from the lower connector prior to operation, for example a closing operation, of the lower master valve. The upper connector may be retractable to at least above the lower master valve.

The lower master valve may comprise a manually operated actuator. However, in other examples the lower master valve may comprise a power operated actuator.

The lower connector may be disposed in a tubing hanger in the wellhead valve assembly. In some examples the lower connector may be disposed above a flowline outlet in the tubing hanger.

The sealed exit may comprise a sealed exit spool. The exit spool may be disposed above a swab valve on top of the wellhead valve assembly. The exit spool may be disposed between a swab valve on top of the wellhead and a least one wing valve in the wellhead.

The sealed exit may comprise a crown plug.

The segment of conduit or cable may comprise a spring-shaped segment. The spring shaped segment may assist in movement, for example retraction, of the upper connector following disconnection from the lower connector. For example, when the lower and upper connectors are in a connected state the spring-shaped segment may be extended in an "energised" state, such that following disconnection the effect of elastic recovery may cause or assist retraction of the lower connector.

The segment of cable or conduit may comprise a plastic portion. Such an arrangement may facilitate easier shearing (for example by a valve such as a master valve) in the event of the segment of cable or conduit not retracting sufficiently.

The lower connector may be mounted, for example suspended, in the wellhead valve assembly. In such an arrangement the cable or conduit may be supported by or suspended from the wellhead valve assembly.

The cable or conduit may extend within the wellbore to provide power and/or communication to/from a downhole location. In one example the cable or conduit may be coupled to a submersible pump deployed at a selected depth in the wellbore.

The wellhead valve assembly may comprise a Christmas tree, such as a vertical Christmas tree, horizontal Christmas tree or the like.

The wellhead valve assembly may facilitate redress and/or change-out of one or more valves contained therein. In some examples complete change-out of one or more valves may be permitted. In some examples one or more parts of a valve may be exchanged, for example all or part of valve internals may be exchanged.

The cable or conduit, for example the segment of the cable or conduit, may be coupled or otherwise in communication with an Emergency Shutdown (ESD) system. The ESD system may de-energise the cable or conduit prior to any disconnection event. Such an arrangement may minimise any risk associated with disconnection and/or shearing while the cable or conduit is energised, for example with electrical current, hydraulic pressure, pneumatic pressure and the like.

An aspect of the present disclosure relates to a method for making and/or breaking a connection between upper and lower connectors within a wellhead valve assembly feedthrough. The method may comprise operating a wellhead valve assembly feedthrough according to any other aspect.

An aspect of the present disclosure relates to a wellhead valve assembly feedthrough for a cable or conduit, comprising:

- a lower connector coupled to an upper end of a cable or conduit disposed in a wellbore, the lower connector disposed below a master valve in the wellhead valve assembly;
- an upper connector movable within in the wellhead valve assembly, the upper connector extensible to connect to the lower connector and retractable to at least above the master valve;
- an actuator coupled to the upper connector; and
- a sealed exit spool having a segment of conduit or cable passing therethrough to outside the wellhead valve assembly, wherein one end of the segment of conduit or cable is moved by the linear actuator.

The actuator may be a linear actuator. The linear actuator may comprise at least one of an electrically operated, a pneumatically operated and a hydraulically operated actuator.

The exit spool may be disposed above a swab valve on top of the wellhead. The exit spool may be disposed between a swab valve on top of the wellhead and a least one wing valve in the wellhead.

The master valve may comprise a power operated actuator. The power operated actuator may comprise at least one of an electrical, pneumatic and hydraulic powered actuator.

The lower connector may be disposed below an upper master valve in the wellhead valve assembly. The upper connector may be moveable through the upper master valve. In some examples the moveable upper connector may be retractable to disconnect from the lower connector prior to operation, for example a closing operation, of the upper master valve. The upper connector may be retractable to above the upper master valve.

The upper master valve may comprise a power operated actuator. In such an arrangement the upper master valve may be defined as an actuated master valve. The power operated actuator may comprise at least one of an electrical, pneumatic and hydraulic powered actuator.

The lower connector may be disposed below a lower master valve in the wellhead valve assembly. The upper connector may be moveable through the lower master valve. In some examples the moveable upper connector may be retractable to disconnect from the lower connector prior to operation, for example a closing operation, of the lower master valve. The upper connector may be retractable to at least above the lower master valve.

The lower master valve may comprise a manually operated actuator. However, in other examples the lower master valve may comprise a power operated actuator.

The segment of conduit or cable may comprise a spring-shaped segment.

An aspect of the present disclosure relates to a wellhead feedthrough for a cable or conduit, comprising:

- a lower connector coupled to an upper end of a cable or conduit disposed in a wellbore, the connector disposed in a tubing hanger in a wellhead above a flowline outlet in the tubing hanger;
- an upper connector having a telescoping connector movably disposed in the wellhead, the telescoping connector extensible to connect to the lower connector and retractable to disconnect therefrom; and
- a sealed feedthrough associated with the upper connector, the sealed feedthrough comprising a connector to couple the telescoping connector to at least one of a fluid conduit and an electrical cable.

An aspect of the present disclosure relates to a wellhead valve assembly feedthrough for a cable or conduit, comprising:

a lower connector coupled to an upper end of a cable or conduit disposed in a wellbore, the lower connector disposed below a master valve in the wellhead valve assembly;

an upper connector connected to the lower connector and having a segment of plastic cable or conduit coupled thereto; and wherein the segment of plastic cable or conduit sealingly exits the wellhead valve assembly through a swab valve of the wellhead valve assembly.

The plastic cable or conduit may be shearable by the master valve when the master valve is operated by at least one of an electric, a pneumatic and an hydraulic actuator.

The master valve may comprise a lower master valve. The master valve may comprise an upper master valve.

An aspect of the present disclosure relates to a wellhead valve assembly feedthrough for a cable or conduit, comprising:

an exit spool coupled between a wellhead and a lower end of a wellhead valve assembly, the exit spool comprising a fluid outlet to the wellhead valve assembly and a sealed exit port for the cable or conduit.

BRIEF DESCRIPTION OF THE DRAWINGS

These and other aspects of the present disclosure will now be described, by way of example only, with reference to the Figures, in which.

DETAILED DESCRIPTION OF THE DRAWINGS

Figure 1:
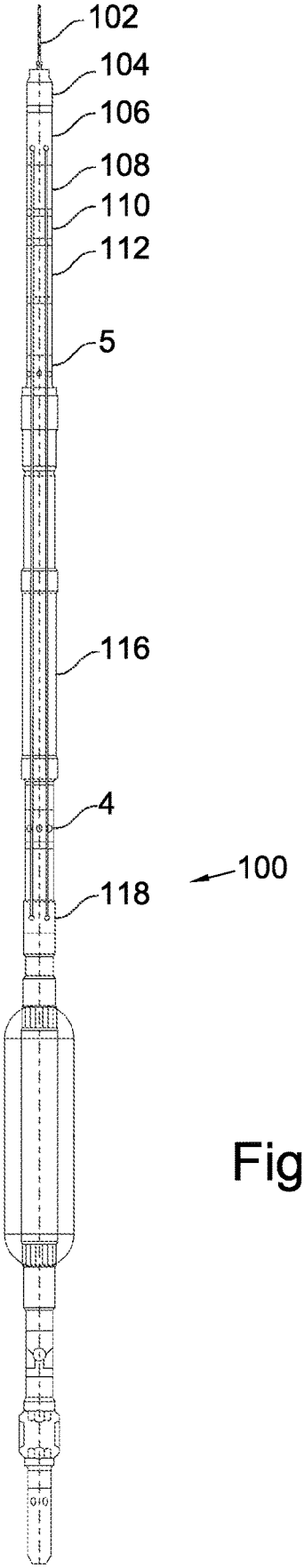
FIG. 1 shows an example of an electrical submersible pump deployed in a subsurface wellbore.

FIG. 1 shows the general arrangement of an ESP system 100 according to one example. The ESP system 100 may be coupled to one end of an electrical cable 102. The electrical cable 102 may be coupled to the ESP system 100 by any known structure of wellbore electrical tool cable head 104. The electrical cable 102 may provide electrical power and/or control signals to operate an electric motor 108. In some examples the electrical cable 102 may be coupled to topside control equipment (not shown) which functions to provide necessary control, such as power and/or control signals, to the ESP system 100. In some examples the topside control equipment may be associated with, for example, an Emergency Shutdown (ESD) system.

Some examples of the electrical cable 102 may be in the form of a tubing encapsulated cable (TEC). An electrical power take-off and signal decoding sub 106 may be disposed intermediate the cable head 104 and the electric motor 108. The electrical power take-off and signal decoding sub 106 may include circuitry (not shown separately) of types known in the art for controlling the operating speed of the electric motor 108 and its direction of rotation in the present example. The sub 106 may also have circuits (not shown separately) for decoding command signals to operate valves in a valve sub 118. The electric motor 108 may be any type known in the art used in ESP systems, for example, a multi-phase induction motor. Depending on the type of pump used, a rotational output of the electric motor 100 may be coupled through a torque converter 110. If used, the torque converter 110 may reduce the rotational speed and increase the torque at its output relative to its input, or vice versa. Rotational output of the torque converter 110 (if used) may pass through a protector/seal assembly 112 and a positive displacement pump 116 such as a progressive cavity pump. The type of pump is not intended to limit the scope of the present disclosure. A fluid discharge for the pump 116 is shown at ports 5. In this respect ports 5 may function as a pump discharge when the pump 116 is operated in a normal or forward direction of rotation. However, when the pump 116 is operated in a reverse direction the ports 5 may function as a pump inlet. The pump 116 may also be a centrifugal pump which does not have a torque converter.

A flow bypass 4 may be disposed below the pump 116. The valve sub 118 may be disposed below the flow bypass 4 and may include valves that may be remotely operated to cause selective operation of various components of the ESP system 100 as required.

Figure 2:
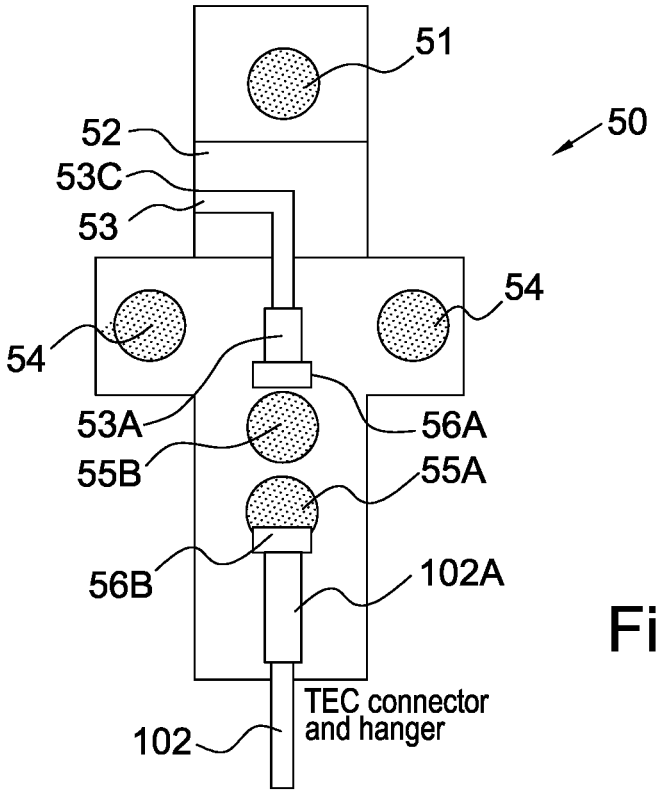
FIG. 2 shows one example of a cable feedthrough in a well head Xmas tree.

In one example of a cable/conduit feedthrough, as shown in FIG. 2, a conventional wellhead Xmas tree 50 includes an actuated master valve 55B (e.g., a gate valve, ball valve or the like), a manually operable master valve 55A, wing valves 54 and a swab valve 51. As illustrated in the present example, the actuated master valve 55B is located above the manually operable master valve 55A. As such, the actuated master valve 55B may be referred to as an upper master valve, and the manually operable master valve 55A may be referred to as a lower master valve. However, in other examples the position of the valves 55A, 55B may be reversed. Further, in other examples the manually operable master valve 55A may also be actuated via a power source.

In the present example an additional spool 52 may be disposed below the swab valve 51 and above the wing valves 54. A cable outlet 53 in the spool 52 includes an upper conduit linear actuator 53A and a side connector 53C. The upper conduit linear actuator 53A may be installed through the swab valve 51 such that an upper electrical connector 56A would be disposed just above the actuated master valve 55B when the upper conduit linear actuator 53A is deactivated. A lower electrical connector 56B may be disposed just below the manually operable master valve 55A. The gap between the two connectors 56A, 56B may be approximately the height of both master valves 55A, 55B. When actuated, the upper conduit linear actuator 53A would extend the upper electrical connector 56A and mate the electrical connectors 56A, 56B. If the upper conduit linear actuator 53A is powered down, a spring (not shown separately) may provide passive biasing force to disengage the connectors 56A, 56B and retract the upper connector 56A to its rest position just above the actuated master valve 55B. The actuated master valve 55B may then be closed, for example in the event of an ESD. In this respect, an associated ESD system may shut-down or de-energise the cable prior to disconnection.

The portion of the conduit or cable traversing the actuated master valve 55B may be made from plastic or other relatively soft material such that it could be sheared by the actuated master valve 55B in the event the connectors 56A, 56B do not disengage correctly. Also the linear actuator assembly 53A could be in a controlled environment to improve reliability. The connectors 56A, 56B may be wet mate-able although in most applications a moderate IP (Ingression Protection) rating would suffice. The linear actuator 53A could be powered by electricity, hydraulics or pneumatics. An example of an electric linear actuator that may be used in some examples may be a model 2000N electric linear actuator (stroke up to 300 mm) sold by SKF Solution Factory, 3443 North Sam Houston Parkway West Building 5 Houston, Tex. 77086. The linear actuator 53A may be modified for the space and operating environment requirements within the wellhead Xmas tree 50.

The example shown in FIG. 2 may be used for connecting fluid pressure communication lines or electrical cables. FIG. 2 depicts a tubing encapsulated cable (TEC) connector and hanger 102A but in other examples, the hanger 102A may be a hydraulic line connector and hanger.

If it is not possible to add a spool (e.g., 52) below the swab valve 51, which may be the case for solid body Xmas trees, the spool 52 and an additional swab valve (not shown) could be connected above the existing swab valve 51, which would be kept open during ordinary ESP operations.

Some possible benefits of the example shown in FIG. 2 may include retaining full Xmas tree functionality; no modifications to the Xmas tree internal components are needed; no flow line modification is needed; and the cable connection can be engaged and disengaged remotely (no need for intervention). The foregoing example is fully scalable for different sizes of conduits, cables and Xmas tree components.

Figure 3:
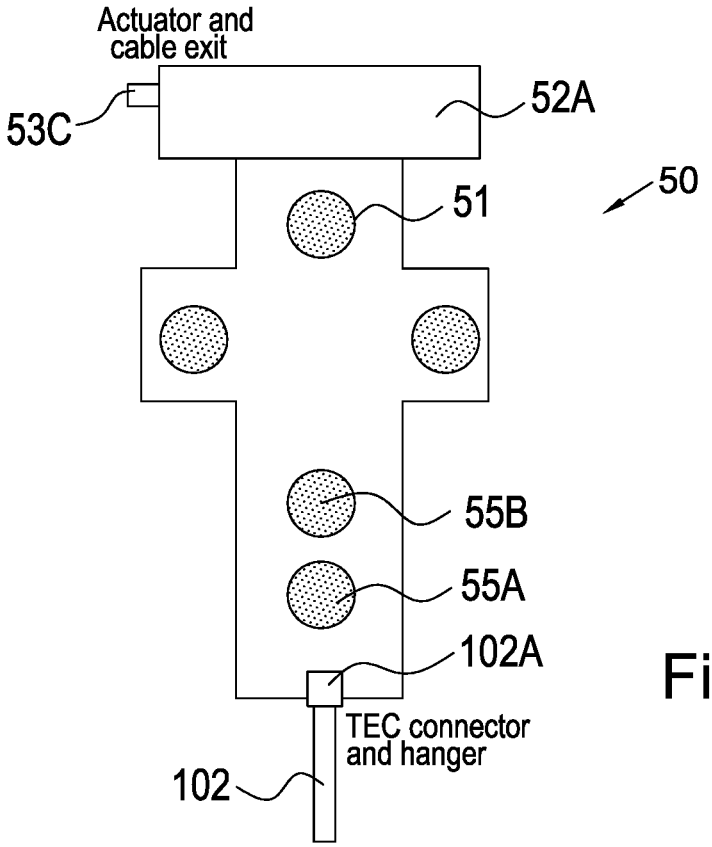
FIG. 3 shows another example of a cable feedthrough.

Another example may comprise a telescopic linear actuator 52A above the swab valve 51 as illustrated in FIG. 3. If space above the Xmas tree is sufficient, a linear actuator (linear motor, or rotary motor, for example with attached worm gear and ball nut all in a sub 52A) may be placed above the swab valve 51, otherwise a telescopic linear actuator 52A as shown in FIG. 3 may be used.

When operated in one direction the telescopic linear actuator 52A would deploy a conduit with connector through the Xmas tree to mate with the TEC connector and hanger 102A. When operated in the other direction the telescopic linear actuator 52A would disconnect and recover the conduit and connector back into the actuator sub. The linear actuator 52A could be fabricated using relatively soft materials such as plastic so that in the event of failure, the actuated master valve 55B can easily shear the portions of the actuator and conduit passing through the master valve 55B and seal the well.

Figure 4:
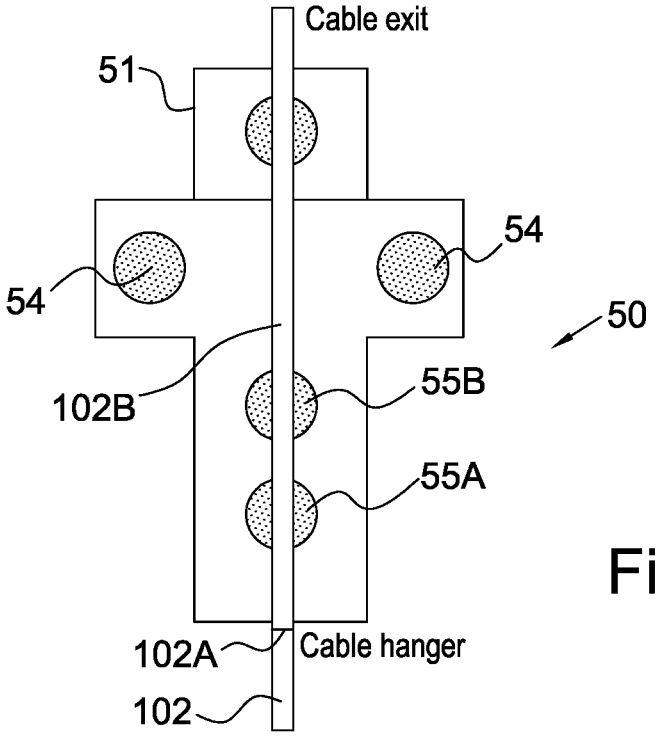
FIG. 4 shows another example of a cable feedthrough.

Other examples may require the need for some intervention in the well after the master valve 55B has been actuated. Referring to FIG. 4, a segment of conduit 102B (which may be fluid lines and/or electrical cable) across the master valves 55A, 55B is made from relatively soft material such as plastic (and electrical conductors made from soft metal such as aluminium or copper) and the master valves 55A, 55B are thus easily able to shear the conduit segment 102B and seal the well. It is generally undesirable to perform well intervention after the actuated master valve 55B is actuated to close, but in some instances it may be acceptable. After the master valve 55B is actuated, there is need to intervene inside the Xmas tree to reconnect the conduit and/or to fish out the sheared off section of conduit 102B. In the present example, the conduit segment 102B that passes through the master valves 55A, 55B is of a suitable 'plastic' construction and the master valves are easily able to shear the 'plastic' conduit and seal. If there are current carrying conductors as part of the conduit, electrical conductors such as those sold under the trademark TeraCopper® may be used. Such electrical conductors may be smaller in size than conventional conductors and thus easier to shear by the master valves 55A, 55B. TeraCopper is a registered trademark of NanoRidge Materials 15850 Vickery Drive, Houston, Tex. 77032. In the example of FIG. 4, the "conventional" part of the cable and/or conduit 102 may be suspended in a hanger 102A at or below the bottom of the master valve 55A to facilitate removal of the conduit of cable 102 after shearing the conduit segment 102B.

Figure 5:
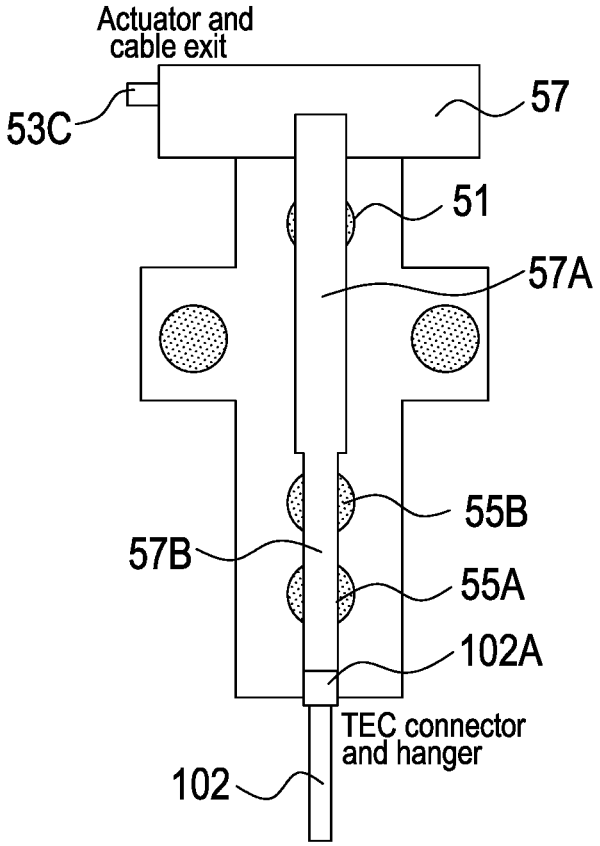
FIG. 5 shows another example of a cable feedthrough.

Referring to FIG. 5 a spring cable (3 conductors arranged as a spring) 57B may be expanded by an actuator 57A and fixed in a TEC connector 102C (e.g., by a retaining pin arrangement). If there is need to disconnect the cable, the actuator 57A may release the TEC connector 102C (e.g. remove retaining pin) and the spring cable 57B would contract such that the master valves 55A, 55B can be closed. Intervention into the Xmas tree may be required to fix the spring cable 57B back into the TEC connector 102C. In the present example of FIG. 5, an actuator sub and cable exit assembly 57 may be mounted on the Xmas tree 50.

Figure 6:
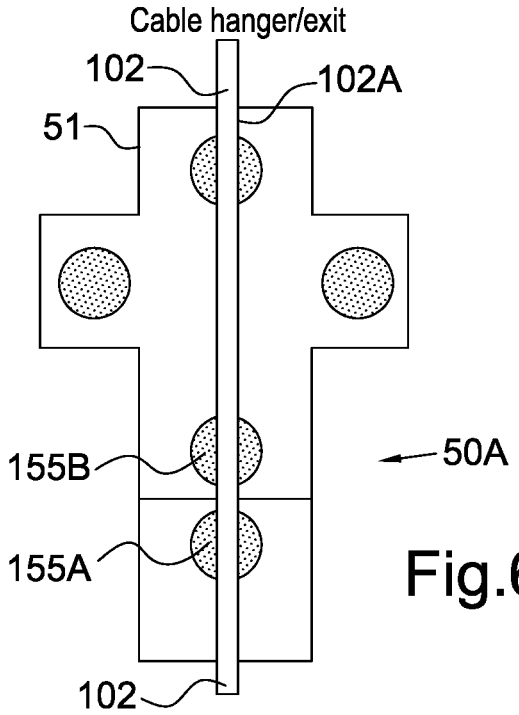
FIG. 6 shows another example of a cable feedthrough.

Another example is shown in FIG. 6, in which one or both master valves are replaced by a blowout preventer (BOP) type seal 155A, 155B, which would seal around the conduit 102 when actuating rams are extended. Another BOP type seal (not shown) could be located above the swab valve 51. The cable 102 may be suspended by a hanger 102A in or above the swab valve 51.

Figure 7:
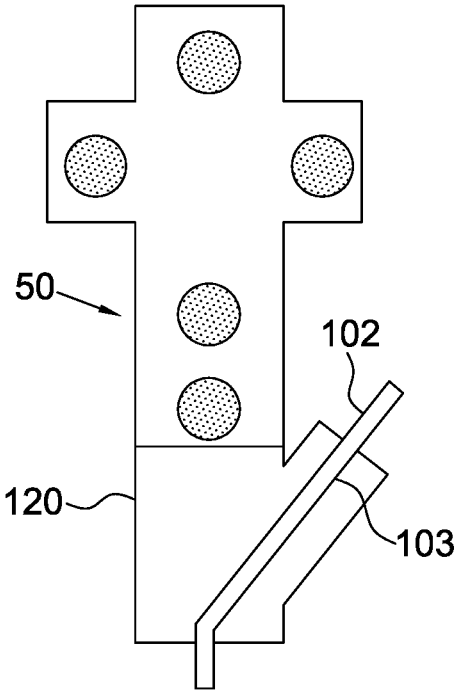
FIG. 7 shows a cable outlet sub disposed below a wellhead.

Another possible example is shown in FIG. 7. In this example, an exit spool 120 may be disposed between the top of the surface casing of the well (not shown) and the base of the Xmas tree 50. The exit spool 120 may include an exit port 103 having suitable seals to contain fluid pressure where the cable 102 passes through the exit port.

Figure 8:
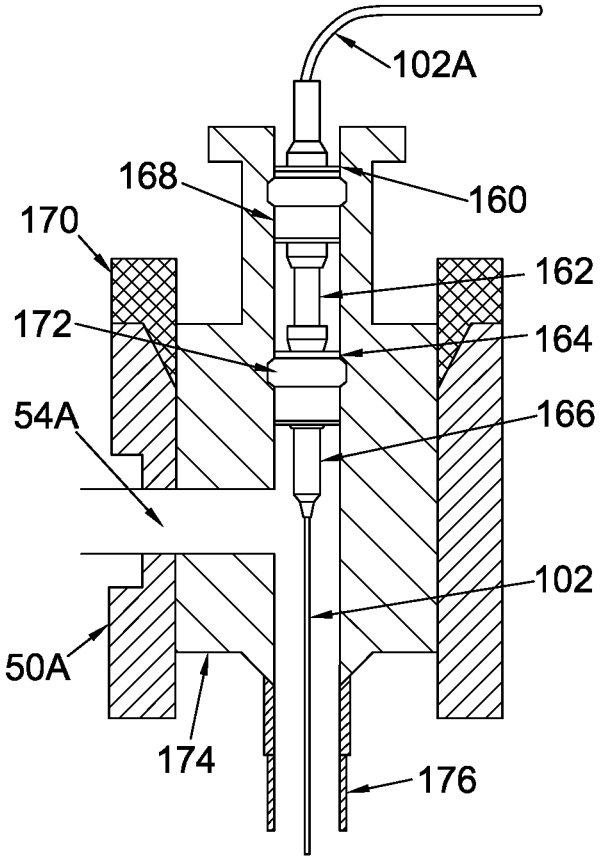
FIG. 8 shows a further example of a cable feedthrough in a horizontal Xmas tree.

FIG. 8 shows an example embodiment for horizontal Xmas trees. In horizontal Xmas trees the master valves are not in line with the through tubing conduit, but are coupled to or form part of a lateral port from the tree body. In FIG. 8, the tree body 50A has a through bore for insertion and retention of a tubing hanger 174. The upper end of a production tubing string 176 may be suspended in the tubing hanger 174. Once the tubing hanger 174 is seated in the tree body 50A, a lock down 170 may be engaged with the tree body 50A to retain the tubing hanger 174 in position within the tree body 50A.

The tubing hanger 174 may comprise a side exit flow line 54A from which well fluids may be discharged.

A lower crown plug 172 may be sealingly engaged in an interior through bore in the tubing hanger 174. An ESP cable 102 or other conduit may be coupled to a suspension device 166 supported in the tubing hanger 174 above the flow line 54A. An upper crown plug 168 may be sealingly engaged in the through bore above the lower crown plug 172. Electrical, hydraulic and/or pneumatic connection between the lower crown plug 172 and the upper crown plug 168 may be made or released by a telescoping joint 162 which may include suitable electrical and or fluid connectors, e.g., a wet mateable connector 164, to establish electrical and or fluid communication between the upper crown plug 168 and the lower crown plug 172. In examples wherein the connection through the tree body 50A is an electrical cable (ESP cable 102), a dry mating connector 160 may be disposed on the upper end of the upper crown plug 168 to enable an electrical "pigtail" 102A to be connected and disconnected from the ESP cable 102 as required.

While the present disclosure has been described with respect to a limited number of examples, those skilled in the art, having benefit of this disclosure, will appreciate that other examples can be devised which do not depart from the scope of the claims. Accordingly, the scope of the present disclosure should be limited only by the attached claims.

The invention claimed is:

1. A wellhead valve assembly feedthrough for a cable or conduit, comprising:

a lower connector disposed within the wellhead valve assembly and being coupled to an upper end of a cable or conduit disposed in a wellbore;

a moveable upper connector disposed above the lower connector, the upper connector extensible to connect to the lower connector and retractable to disconnect from the lower connector, wherein the lower connector is disposed below a master valve in the wellhead assembly and the upper connector is moveable through the master valve; and a sealed exit arrangement having a segment of conduit or cable passing therethrough to outside the wellhead valve assembly, wherein one end of the segment of conduit or cable is connected to the upper connector.

2. The wellhead valve assembly feedthrough according to claim 1, comprising a linear actuator coupled to the upper connector.

3. The wellhead valve assembly feedthrough according to claim 1, wherein the moveable upper connector is retractable to a position above the master valve.

4. The wellhead valve assembly feedthrough according to claim 1, wherein the moveable upper connector is retractable to disconnect from the lower connector prior to operation of the master valve.

5. The wellhead valve assembly feedthrough according to claim 1, wherein the master valve comprises a power operated actuator.

6. The wellhead valve assembly feedthrough according to claim 1, wherein the master valve comprises a manually operated valve.

7. The wellhead valve assembly feedthrough according to claim 1, wherein the master valve comprises an upper master valve disposed above a lower master valve in the wellhead valve assembly and wherein the lower connector is disposed below the upper master valve.

8. The wellhead valve assembly feedthrough according to claim 7, wherein the moveable upper connector is moveable through the upper master valve.

9. The wellhead valve assembly feedthrough according to claim 7, wherein the moveable upper connector is retractable to disconnect from the lower connector prior to operation of the upper master valve.

10. The wellhead valve assembly feedthrough according to claim 7, wherein the upper connector is retractable to above the upper master valve.

11. The wellhead valve assembly feedthrough according to claim 7 wherein the upper master valve comprises a power operated actuator.

12. The wellhead valve assembly feedthrough according to claim 7, wherein the lower connector is disposed below the lower master valve.

13. The wellhead valve assembly feedthrough according to claim 12, wherein the moveable upper connector is moveable through the lower master valve.

14. The wellhead valve assembly feedthrough according to claim 12, wherein the moveable upper connector is retractable to disconnect from the lower connector prior to operation of the lower master valve.

15. The wellhead valve assembly feedthrough according to claim 12, wherein the upper connector is retractable to at least above the lower master valve.

16. The wellhead valve assembly feedthrough according to claim 12, wherein the lower master valve comprises a manually operated actuator.

17. The wellhead valve assembly feedthrough according to claim 1, wherein the lower connector is disposed in a tubing hanger in the wellhead valve assembly.

18. The wellhead valve assembly feedthrough according to claim 17, wherein the lower connector is disposed above a flowline outlet in the tubing hanger.

19. The wellhead valve assembly feedthrough according to claim 1, wherein the sealed exit arrangement comprise a sealed exit spool.

20. The wellhead valve assembly feedthrough according to claim 19, wherein the exit spool is disposed above a swab valve on top of the wellhead valve assembly.

21. The wellhead valve assembly feedthrough according to claim 19, wherein the exit spool is disposed between a swab valve on top of the wellhead valve assembly and a least one wing valve in the wellhead valve assembly.

22. The wellhead valve assembly feedthrough according to claim 1, wherein the sealed exit arrangement comprises a crown plug.

23. The wellhead valve assembly feedthrough according to claim 1, wherein the segment of conduit or cable comprises a spring-shaped segment.

24. The wellhead valve assembly feedthrough according to claim 23, wherein the spring shaped segment assists retraction of the upper connector following disconnection from the lower connector.

25. The wellhead valve assembly feedthrough according to claim 1, wherein the segment of cable or conduit comprises a plastic portion.

26. The wellhead valve assembly feedthrough according to claim 1, wherein the lower connector is mounted in the wellhead valve assembly such that the cable or conduit is suspended from the wellhead valve assembly.

27. The wellhead valve assembly feedthrough according to claim 1, wherein the cable or conduit extends within the wellbore to provide power and/or communication to/from a downhole location.

28. The wellhead valve assembly feedthrough according to claim 1, wherein the cable or conduit is coupled to a submersible pump deployed at a selected depth in the wellbore.

29. The wellhead valve assembly feedthrough according to claim 1, wherein the cable or conduit is in communication with an Emergency Shutdown (ESD) system.

30. The wellhead valve assembly feedthrough according to claim 1, wherein the wellhead valve assembly comprises a Xmas tree.

31. The wellhead valve assembly feedthrough according to claim 30, wherein the Xmas tree is a vertical Xmas tree.

32. The wellhead valve assembly feedthrough according to claim 30, wherein the Xmas tree is a horizontal Xmas tree.

33. A wellhead valve assembly feedthrough for a cable or conduit, comprising:

a lower connector coupled to an upper end of a cable or conduit disposed in a wellbore, the lower connector disposed below a master valve in the wellhead valve assembly;

an upper connector movable within in the wellhead valve assembly, the upper connector coupled to an end of a segment of conduit or cable, the upper connector extensible to connect to the lower connector and retractable to at least above the master valve;

an actuator coupled to the upper connector; and a sealed exit spool having the segment of conduit or cable passing therethrough to outside the wellhead valve assembly, wherein the end of the segment of conduit or cable is moved by the actuator by moving the upper connector.

* * * * *